US010996605B2

(12) United States Patent
Ezetta et al.

(10) Patent No.: US 10,996,605 B2
(45) Date of Patent: May 4, 2021

(54) COORDINATION OF ZONES IN PRINTERS

(71) Applicant: Hewlett-Packard Development Company, L.P., Spring, TX (US)

(72) Inventors: Elizabeth Ezetta, Vancouver, WA (US); Bruce A Axten, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/331,574

(22) PCT Filed: Sep. 9, 2016

(86) PCT No.: PCT/US2016/051032

§ 371 (c)(1),
(2) Date: Mar. 8, 2019

(87) PCT Pub. No.: WO2018/048419

PCT Pub. Date: Mar. 15, 2018

(65) Prior Publication Data

US 2019/0219958 A1 Jul. 18, 2019

(51) Int. Cl.
*G03G 15/00* (2006.01)

(52) U.S. Cl.
CPC ..... *G03G 15/5083* (2013.01); *G03G 15/50* (2013.01); *G03G 2215/00113* (2013.01)

(58) Field of Classification Search
USPC ..... 399/76
See application file for complete search history.

(56) References Cited

U.S. PATENT DOCUMENTS 4,660,077 A * 4/1987 Kawamura ..... H04N 1/0473 358/515
5,061,101 A 10/1991 Kondo et al.
5,130,724 A 7/1992 Crowley
5,444,525 A * 8/1995 Takahashi ..... G03G 15/326 399/76
5,507,478 A 4/1996 Nottingham et al.
5,703,693 A * 12/1997 Morikawa ..... G03G 15/231 358/296

(Continued)

FOREIGN PATENT DOCUMENTS

CN 1830176 A 9/2006
CN 102236531 A 11/2011

(Continued)

OTHER PUBLICATIONS

Microsoft ~ How to: Determine. Printer Status and Print Job Status From Visual Basic, 2014, https://support.microsoft.com/ ~ 16 pages.

*Primary Examiner* — Q Grainger
*Assistant Examiner* — Quana Grainger
(74) *Attorney, Agent, or Firm* — Brooks Cameron & Huebsch PLLP

(57) ABSTRACT

Example implementations relate to print zone coordination. For example, a system for print zone coordination may include a plurality of printing zones, and a plurality of fibers, each fiber among the plurality of fibers assigned to a different printing zone among the plurality of printing zones. The system may further include a threading coordination system to coordinate a print job through the plurality of printing zones using the plurality of fibers.

15 Claims, 4 Drawing Sheets

(56) References Cited

U.S. PATENT DOCUMENTS

| | | | | |
|---|---|---|---|---|
| 6,179,409 | B1 * | 1/2001 | Takahashi | G06K 15/02 347/40 |
| 6,189,023 | B1 * | 2/2001 | Emlich | G06F 9/4843 718/100 |
| 6,539,198 | B2 * | 3/2003 | Miyajima | G03G 15/234 399/389 |
| 7,699,305 | B2 | 4/2010 | Totsuka et al. | |
| 8,731,447 | B2 * | 5/2014 | Krucinski | G03G 15/1615 198/806 |
| 8,965,234 | B2 * | 2/2015 | Ikuta | G03G 15/0189 358/1.18 |
| 10,005,629 | B2 * | 6/2018 | Hojo | B65H 1/00 |
| 2002/0076232 | A1 | 6/2002 | Taneko | |
| 2005/0071495 | A1 * | 3/2005 | Kadota | G06F 3/1263 709/232 |
| 2007/0070403 | A1 * | 3/2007 | Toda | G06F 3/1284 358/1.15 |
| 2007/0085889 | A1 * | 4/2007 | Cardells | B41J 2/2139 347/101 |
| 2008/0187344 | A1 * | 8/2008 | Yoshizawa | G03G 15/6573 399/76 |
| 2008/0253818 | A1 * | 10/2008 | Sasaki | G03G 15/238 399/401 |
| 2008/0278526 | A1 | 11/2008 | Brooks et al. | |
| 2009/0142088 | A1 * | 6/2009 | Tanaka | G03G 15/234 399/76 |
| 2014/0210923 | A1 | 7/2014 | Winters et al. | |

FOREIGN PATENT DOCUMENTS

| | | | | |
|---|---|---|---|---|
| CN | 102862402 | A | 1/2013 | |
| EP | 3314391 | | 5/2018 | |
| JP | 2002-185667 | | 6/2002 | |
| JP | 2007-106559 | | 4/2007 | |
| JP | 2013-195519 | A | 9/2013 | |
| WO | WO-9917195 | A1 * | 4/1999 | G06F 9/4843 |

* cited by examiner

COORDINATION OF ZONES IN PRINTERS

BACKGROUND

Among the types of office equipment that consume power, printing devices have dynamic power use that may depend on a state of the printer (e.g., standby, warm up, scanning and printing). Moreover, printing devices may be comprised of numerous components that work in coordination to complete a print job.

DETAILED DESCRIPTION

Printing devices may handle a plurality of pages of printing media. Such printing devices may coordinate the transportation of the printing media within the printing device using various mechanisms. However, such printing devices may not meet current demands for media handling and power usage. Although the disclosure herein refers to "printing devices", it is to be understood that the present disclosure applies equally to devices that do not print, such as "finishing devices", among other examples.

Print zone coordination, according to the present disclosure, may allow switching between zones of the printing device separately. According to the present disclosure, a printing device may be divided up into subsystems which may be managed by a cooperative threading system referred to as fibers. The fibers may manage these zones, and wake up and execute when a page of print media is about to enter the respective zone. The fibers for each zone may return to an idle state once the page of print media has exited the zone. Print zone coordination, according to the present disclosure, may allow the printing device to handle multiple pages of print media at one time with minimal energy usage.

Figure 1:
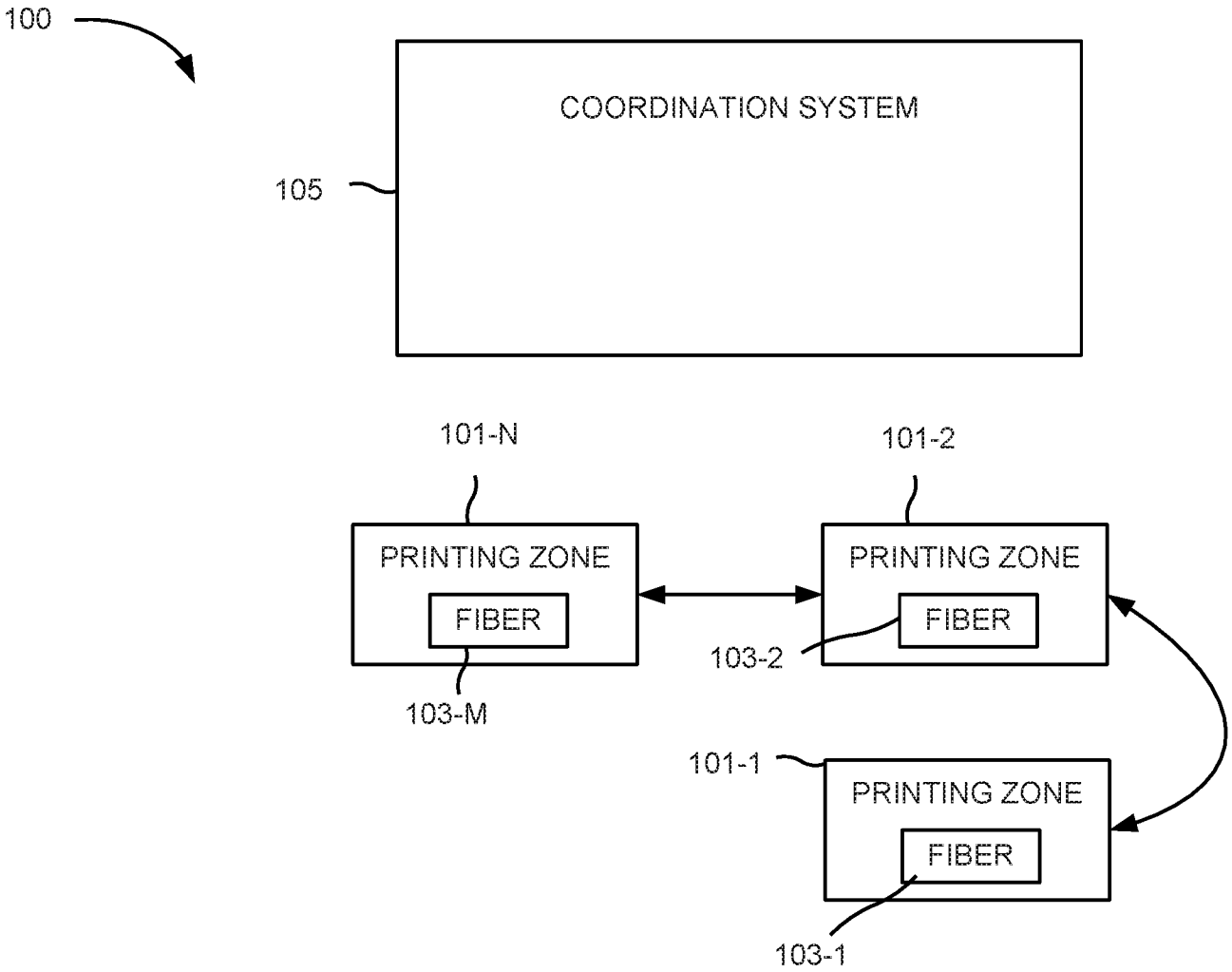
FIG. 1 illustrates a diagram of an example system, according to the present disclosure.

FIG. 1 illustrates a diagram of an example system 100, according to the present disclosure. As illustrated in FIG. 1, the system 100 may include a plurality of printing zones 101-1, 101-2, . . . 101-N (referred to collectively as printing zones 101). Although FIG. 1 illustrates three printing zones 101, examples are not so limited and the system 100 may include more or fewer printing zones 101 than illustrated. As used herein, a printing zone refers to a subsystem of a printing device that performs a task relating to printing. Examples of printing zones may include a deskew zone, a printing zone, a duplex entry zone, and a threading control zone, among others. As discussed herein, the system 100 may allow for switching between printing zones within the printing device. That is the system 100 may allow for a single zone to operate while all other zones remain in a low power state. As such, each printing zone may include a plurality of sensors to detect movement of media. That is, each of the plurality of printing zones 101 may have a sensor or a plurality of sensors that identify when a media, such as paper, is leaving the printing zone.

As illustrated in FIG. 1, the system 100 may also include a plurality of fibers 103-1, 103-2, . . . , 103-M (herein referred to collectively as fibers 103). As used herein, a fiber refers to a lightweight thread of instruction execution that allows for cooperative multitasking with other fibers. Fibers can be, for example, a unit of execution as defined by the Microsoft Developer Network Library, and can be scheduled by a thread of execution (e.g., a thread) and run in the context of the thread. Each of the plurality of zones 101 may be associated with a fiber. That is, each fiber among the plurality of fibers 103 may be assigned to a different printing zone among the plurality of printing zones 101. The plurality of fibers 103 may each be responsible for a printing zone, and may remain in a low power, or "ready" state, when not in use. That is, the fibers for a particular printing zone may "wake up" or become active when a page of print media is about to enter the printing zone. For example, fiber 103-2 may be responsible for printing zone 101-2. Fiber 103-2 may remain in a ready state until a print media is about to enter printing zone 101-2, at which point fiber 103-2 may enter an active state. As used herein, a "ready" state of a fiber refers to an initial state, or low power state of the fiber, where the fiber may initiate action in response to an input. As described herein, a fiber may move from the ready state to an active state in response to a change in an event flag.

The system 100 may include a threading coordination system 105 including the plurality of fibers to coordinate a print job through the plurality of printing zones 101 using the plurality of fibers 103. Although FIG. 1 illustrates the threading coordination system 105 as a separate component from the printing zones 101 and fibers 103, it is to be understood that the threading coordination system 105 includes fibers 103. That is, the threading coordination system 105 refers to a system of fibers and other computing resources to communicate between zones 101 of system 100. While some fibers may be located in a central located in system 100, some fibers may be located within each zone, as illustrated. The plurality of fibers 103 may remain in the ready state until notified by the threading coordination system 105 that a print media will be entering the associated printing zone. In response, the threading coordination system 105, via fibers 103, may initiate motors in a particular printing zone among the plurality of printing zones 101 in response to receipt of a wake signal from a printing zone preceding the particular printing zone. For example, a print job may proceed through printing zone 101-1, then printing zone 101-2, then printing zone 101-1. As such, fiber 103-1 may be active while print media is in printing zone 101-1, while fibers 103-2 and 103-M remain in the ready state. Zone 101-1 may receive a signal, in the form of an event flag, from printing zone 101-1, indicating that the print medium will be arriving in printing zone 101-2 and that fiber 103-2 should move to the active state. Moreover, sensors in printing zones 101-1 and 101-2 may provide information to the respective printing zone about the location of the print media. That is, printing zone 101-1 may have a sensor or a plurality of sensors that detect arrival and/or departure of the print media. Similarly, printing zones 101-1 and 101-M may have a sensor or a plurality of sensors that detect arrival and/or departure of the print media. In such a manner, the threading coordination system 105 may initiate motors in a particular printing zone in response to detection, by the sensors in the particular printing zone, presence of the printing media.

Put another way, any time a fiber in system 100 is waiting on another component of system 100, such as another page to print, a motor to move, or another printing zone to switch to the active state, the waiting fiber allows other fibers to run while it waits. In such a manner, the waiting fiber waits in a ready state, does not take up central processing unit (CPU) resources, and allows execution of other processes in system 100. As such, the threading coordination system 105 may maintain a first printing zone among the plurality of printing zones 101 in an active state and a remainder of the printing zones 101 in a ready state. Moreover, the threading coordination system 105 may return the first printing zone, via the fibers in the first printing zone, to the ready state in response to a determination that another printing zone among the plurality of printing zones 101 is active. Examples are not limited to maintaining a single zone in an active state while the remainder are in a ready state. For instance, a plurality of the printing zones may be in the active state while the remainder are in the ready state. In such a manner, the system 100 may use less energy and less CPU resources.

The threading communication system 105 may coordinate switching between printing zones 101 using event flags that wake up the fibers 103 when the event flag is set. The event flags may be used to communicate between printing zones. That is, using the threading coordination system 105, an event flag associated with printing zone 101-2 may be set, which indicates that a print job will be arriving at printing zone 101-2. In response to the setting of the event flag of the printing zone 101-2, fiber 103-2 may be set to active and motors associated with printing zone 101-2 may initiate. In such a manner, the threading coordination system 105 may notify fibers associated with a second printing zone of an upcoming arrival of print media, and initiate motors in the second printing zone in response to the notification.

Figure 2:
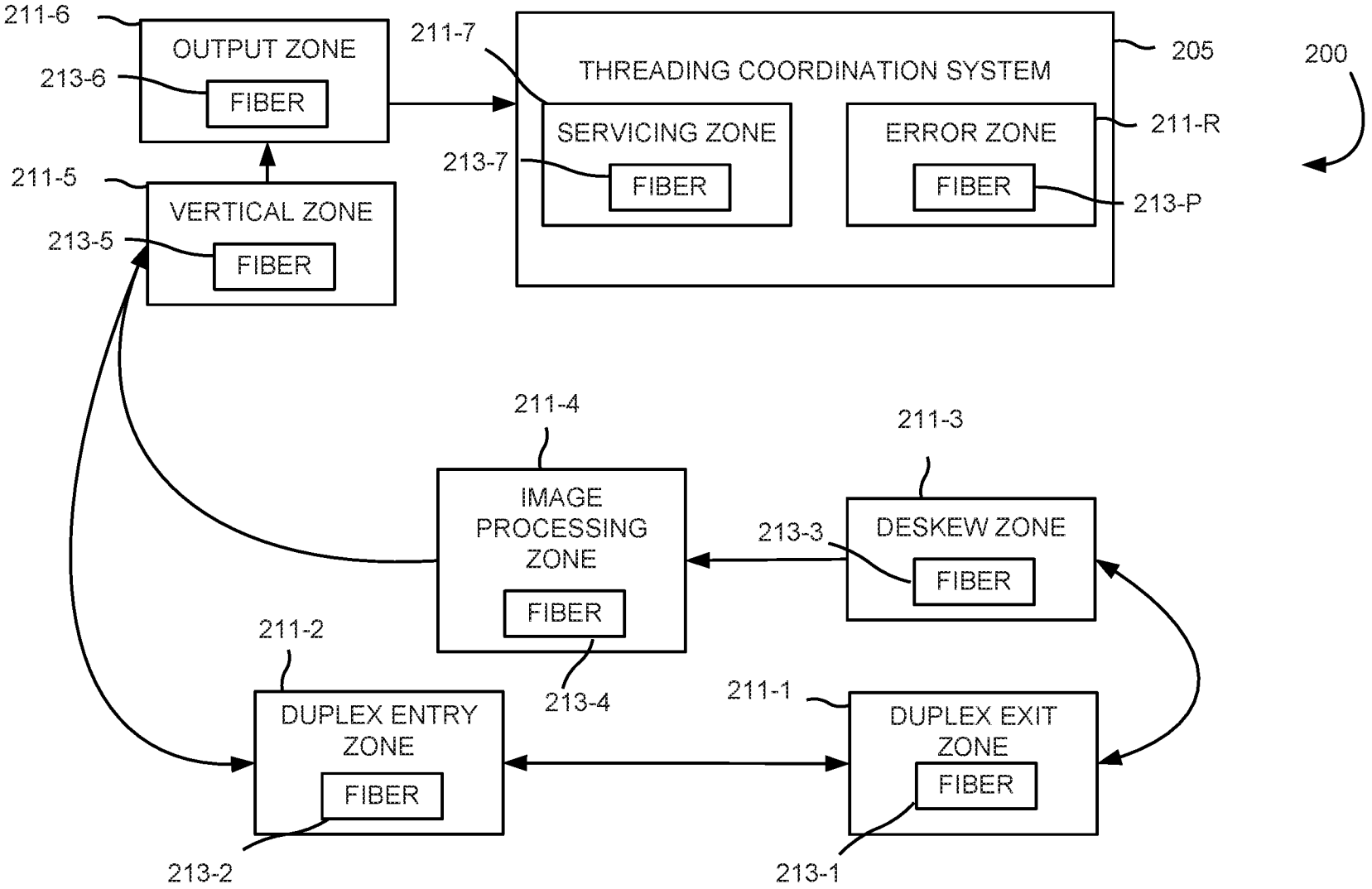
FIG. 2 further illustrates a diagram of an example system for printing zone coordination, according to the present disclosure.

FIG. 2 further illustrates a diagram of an example system 200 for printing zone coordination, according to the present disclosure. System 200 may be analogous to system 100 illustrated in FIG. 1. As illustrated in FIG. 2, and discussed in relation to FIG. 1, the system 200 may include a plurality of printing zones, and each printing zone may be managed by associated fibers.

For instance, system 200 may include a duplex exit zone 211-1 and a duplex entry zone 211-2, both of which may be used to print in a duplex form. Zones 211-1 and 211-2 may be managed by fibers 213-1 and 213-2, respectively. Similarly, system 200 may include a deskew zone 211-2 and a printing zone 211-4. Moreover, system 200 may include a vertical zone 211-5 to pass the media in a vertical position within system 200, and an output zone 211-6 to feed the media to an output tray. Each of zones 211-3, 211-4, 211-5, and 211-6 may be managed by an associated fiber, 213-3, 213-4, 213-5, and 213-6, respectively.

Notably, system 200 may include more, fewer, and/or different zones than illustrated in FIG. 2. For example, the system 200 may include a tray zone to control a media input tray, a picker zone to control selection of a set of instructions, an input path zone to further control the media tray, and a finisher zone to control finishing processes.

Moreover, the thread coordination system 205 may also include printing zones and associated fibers. For instance, the thread coordination system 205 may include a servicing zone 211-7, and an error zone 211-R, each managed by respective fibers 213-7 and 213-P, respectively. As used herein, the error zone refers to a portion of the threading coordination system that detects and reports errors within system 200. While FIG. 2 illustrates two printing zones included in threading coordination system 205, examples are not so limited and system 200 may include more or fewer printing zones than illustrated. For example, the threading coordination system 205 may also include a page zone, a page tracker zone, a power recovery zone, and/or a monitor zone, among others. Again, each respective zone may be managed by a different respective fiber.

As described herein, each zone may be activated using the respective fibers as the print job proceeds through system 200. For example, during printing, image processing zone 211-4 may set itself to active to indicate to all other zones in system 200 that it is not ready to handle another page. Once the image processing zone 211-4 is ready to deliver the page to the next zone, e.g., the vertical zone 211-5, the image processing zone 211-4 may check the status of the vertical zone 211-5. If the vertical zone 211-5 is in a ready state, then the image processing zone 211-4 may notify the vertical zone 211-5 by setting an event flag in fiber 213-4, indicating to fiber 213-5 that the print job will be arriving at vertical zone 211-5 soon. The fiber 213-4 may coordinate this communication with thread coordination system 205. The image processing zone 211-4 may then initiate the movement of the print media to vertical zone 211-5, and the event flag of fiber 213-4 may be set back to the "ready" state from the "active" state, indicating that image processing zone 211-4 may once again accept print jobs. The event flag for fiber 213-4 may be set back to the ready state once the paper has left image processing zone 211-4, as detected by sensors within image processing zone 211-4. This process may continue, by passing print media through system 200, setting fibers to active or ready, using event flags.

Figure 3:
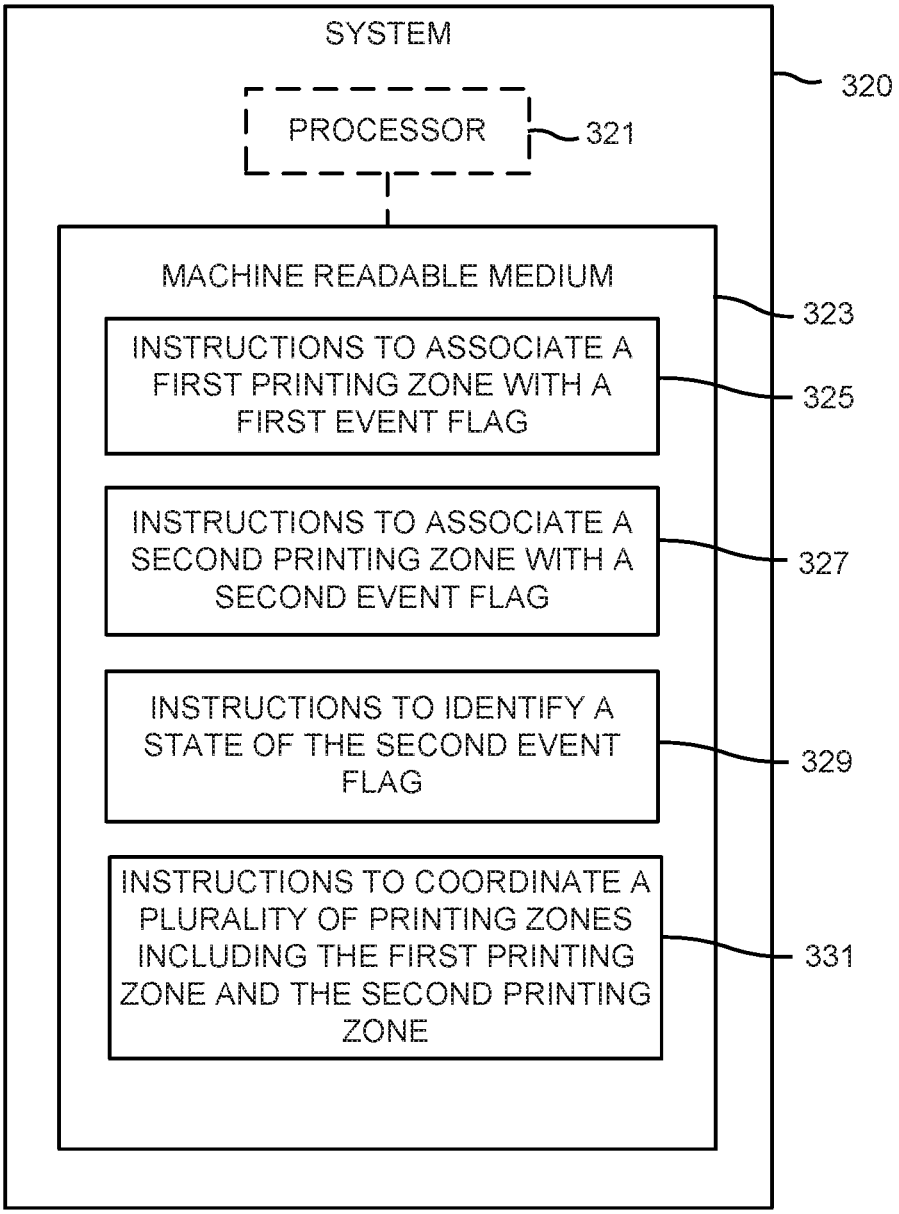
FIG. 3 is a block diagram of an example system for printing zone coordination, according to the present disclosure.

FIG. 3 is a block diagram of an example system 320 for printing zone coordination, according to the present disclosure. System 320 may be the same as or different than, the system 100 illustrated in FIG. 1 and the system 200 illustrated in FIG. 2. System 320 may include at least one computing device that is capable of communicating with at least one remote system. In the example of FIG. 3, system 320 includes a processor 321 and a machine-readable medium 323. Although the following descriptions refer to a single processor and a single machine-readable medium, the descriptions may also apply to a system with multiple processors and machine-readable mediums. In such examples, the instructions may be distributed (e.g., stored) across multiple machine-readable mediums and the instructions may be distributed (e.g., executed by) across multiple processors.

Processor 321 may be one or more central processing units (CPUs), microprocessors, and/or other hardware devices suitable for retrieval and execution of instructions stored in machine-readable medium 323. In the particular example shown in FIG. 3, processor 321 may receive, determine, and send instructions 325, 327, 329, and 331 for printing zone coordination. As an alternative or in addition to retrieving and executing instructions, processor 321 may include one or more electronic circuits comprising a number of electronic components for performing the functionality of one or more of the instructions in machine-readable medium 323. With respect to the executable instruction representations (e.g., boxes) described and shown herein, it should be understood that part or all of the executable instructions and/or electronic circuits included within one box may, in alternate embodiments, be included in a different box shown in the figures or in a different box not shown.

Machine-readable medium 323 may be any electronic, magnetic, optical, or other physical storage device that stores executable instructions. Thus, machine-readable medium 323 may be, for example, Random Access Memory (RAM), an Electrically-Erasable Programmable Read-Only Memory (EEPROM), a storage drive, an optical disc, and the like. Machine-readable medium 323 may be disposed within system 320, as shown in FIG. 3. In this situation, the executable instructions may be "installed" on the system 320. Additionally and/or alternatively, machine-readable medium 323 may be a portable, external or remote storage medium, for example, that allows system 320 to download the instructions from the portable/external/remote storage medium. In this situation, the executable instructions may be part of an "installation package". As described herein, machine-readable medium 323 may be encoded with executable instructions for printing zone coordination.

Referring to FIG. 3, instructions 325, when executed by a processor (e.g., 321), may cause system 320 to associate a first printing zone of a printing device with a first event flag. For instance, as described in relation to FIG. 2, each printing zone may be managed by a fiber, and each fiber may have an event flag that indicates the status of the fiber (and thereby, the zone) to all other fibers. Similarly, instructions 327, when executed by processor 321 may cause system 320 to associate a second printing zone of the printing device with a second event flag. As described herein, each event flag may indicate a state of the associated fiber and zone. That is, an event flag of a second printing zone may indicate that the second printing zone is in a ready state. In response to the indication that the second printing zone is in the ready state, coordination of the print job may include proceeding print media from first printing zone to second printing zone. That is, if the second printing zone is not in a ready state, the media may not pass to the second printing zone.

Instructions 329, when executed by a processor 321 may cause system 320 to identify a state of the second event flag, by the first printing zone. For example, the instructions 329 to identify the state of the second printing zone may include instructions to determine that the second printing zone is not in a ready state. In response to the determination that the second printing zone is not in the ready state, coordination of the print job may include not preceding the print job from the first printing zone to the second printing zone. In such instance, the first printing zone may send a wake signal to the second printing zone such that the second printing zone may move to the ready state and proceed with the print job. As such, instructions 331, when executed by a processor 321, may cause system 320 to coordinate a print job through the first printing zone and the second printing zone based on the state of the second printing zone. That is, if the second printing zone is in a ready state, the print job may proceed from the first printing zone to the second printing zone, as described in relation to FIG. 2.

Although reference is made herein to moving a print job from a "first" printing zone to a "second" printing zone, examples are not so limited, and the same description applies to subsequent printing zones. For instance, in some examples, the system 320 may include instructions (not illustrated in FIG. 3), that when executed by the processor 321, may cause system 320 to associate a third printing zone with a third event flag, and coordinate the print job through the first printing zone, the second printing zone, and the third printing zone based on each of the first event flag, the second event flag, and the third event flag. That is, as described in relation to FIG. 2, a first printing zone may set an event flag that sends a wake signal to the second printing zone. Similarly, the second printing zone may set an event flag that sends a wake signal to the third printing zone. That is, the second and third printing zones may be maintained in a ready state until receipt of a wake signal from the preceding zone.

Figure 4:
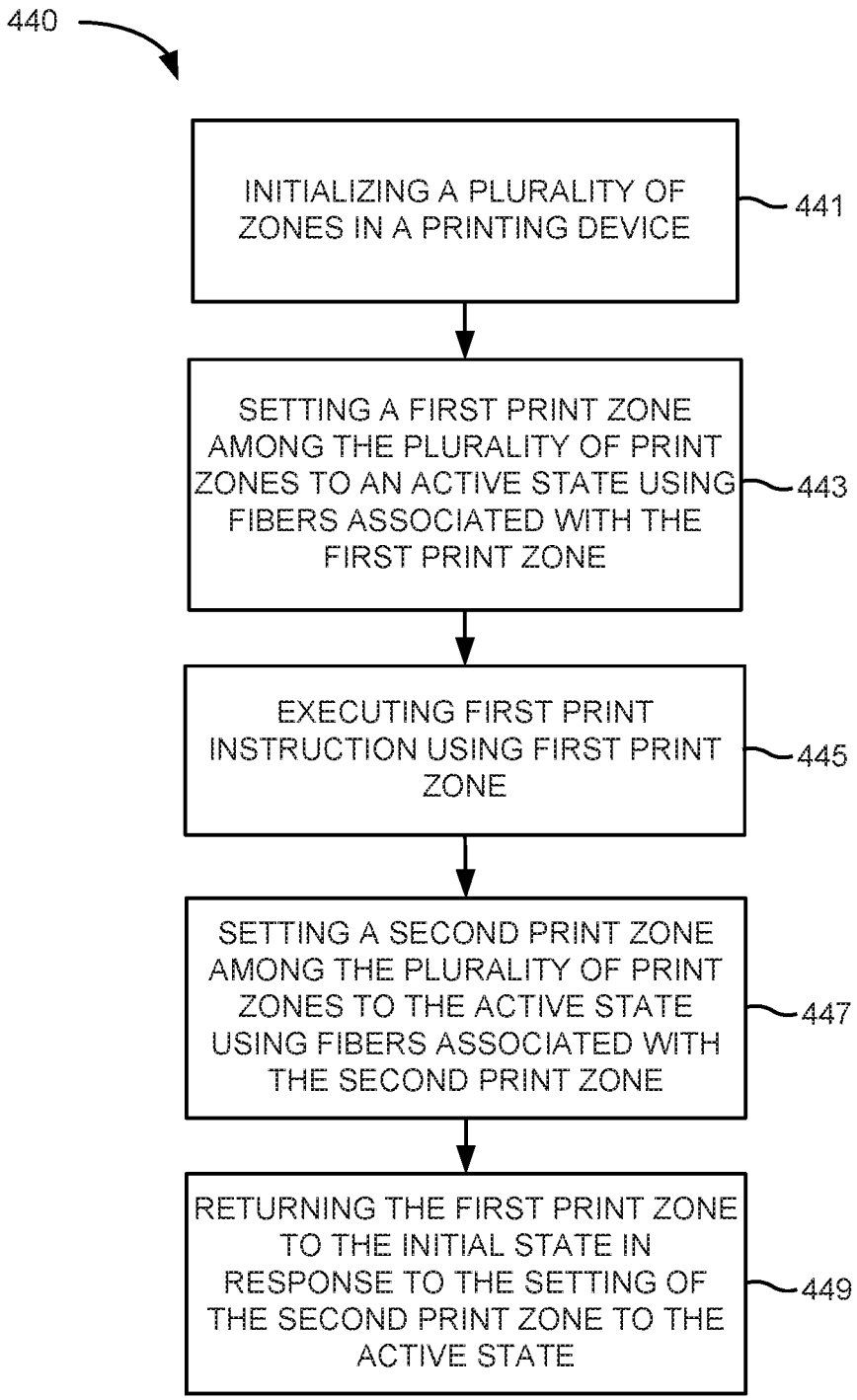
FIG. 4 illustrates an example method for printing zone coordination, according to the present disclosure.

FIG. 4 illustrates an example method 440 for printing zone coordination, according to the present disclosure. At 441, the method 440 includes initializing a plurality of printing zones in a printing device. As described herein, initializing the plurality of printing zones refers to setting each of the printing zones to a "ready" state, such that each state may move to an active state upon receipt of instructions.

At 443, the method 440 may include setting a first printing zone among the plurality of printing zones to an active state using fibers associated with the first printing zone. As described in relation to FIGS. 1 and 2, each printing zone may be managed by different respective fibers. Also, as described in relation to FIGS. 1 and 2, at 445, the method 440 may include executing first print instruction using first printing zone. That is, each printing zone may perform a different respective task related to completing a print job. As the print job is processed by a respective printing zone, instructions related to the operations of that particular printing zone may be executed.

At 447, the method 440 may include setting a second printing zone among the plurality of printing zones to the active state using fibers associated with the second printing zone. That is, upon execution of the instructions associated with the first printing zone, an event flag may be set in the first printing zone, which indicates to the second printing zone that the print job will be arriving soon. As such, the method 440 may include setting the second printing zone to the active state by the first printing zone setting an event flag of the second printing zone. That is, in response to a wake signal received from the first printing zone, the event flag associated with the second printing zone (and the associated fibers) may be set to active, indicating that the second printing zone is now actively executing instructions to complete the print job.

In some examples, the method 440 may include returning the first printing zone to the initial state in response to the setting of the second printing zone to the active state. That is, once the print job has proceeded to a subsequent printing zone, the preceding printing zone may return to an initial or "ready" state, and thereby preserve CPU resources and energy.

In some examples, the method 440 may include initiating motors in a subsequent printing zone, in response to the setting of the printing zone in the active state. For example, the method may include initiating motors in a second printing zone in response to the setting of the second printing zone in the active state, as described herein.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, the designators "N", "M", "P", and "R", particularly with respect to reference numerals in the drawings, indicates that a number of the particular feature so designated can be included with examples of the present disclosure. As used herein, "a number of" an element and/or feature can refer to one or more of such elements and/or features.

What is claimed:

1. A system, comprising:

a plurality of zones of a printing device;

a threading coordination system, including a plurality of fibers, to coordinate a print job through the plurality of zones, wherein the plurality of fibers are assigned to different zones of the printing device and wherein a fiber of the plurality of fibers is to wait in a ready state in response to a determination that another fiber in another zone of the printing device is active.

2. The system of claim 1, wherein each zone of the plurality of zones includes a plurality of sensors to detect movement of media.

3. The system of claim 2, the threading coordination system to initiate motors in a particular zone among the plurality of zones in response to:

receipt of a wake signal from a zone preceding the particular zone; and detection, by the sensors in the particular zone, a presence of media.

4. The system of claim 1, comprising the threading coordination system to:

maintain a first zone among the plurality of zones in an active state and a remainder of zones in a ready state.

5. The system of claim 4, comprising the threading coordination system to:

return the first zone to the ready state in response to a determination that another zone among the plurality of zones is active.

6. The system of claim 4, comprising the threading coordination system to:

notify fibers associated with a second zone of an upcoming arrival of print media; and initiate motors in the second zone in response to the notification.

7. A non-transitory machine readable medium storing instructions executable by a processing resource to:

associate a first zone of a printing device with a first event flag, wherein the first zone contains a first fiber;

associate a second zone of the printing device with a second event flag, wherein the second zone contains a second fiber;

identify a state of the second event flag by the first zone; and coordinate a plurality of zones, including the first zone and the second zone, based on the state of the second zone, wherein the first fiber is to wait in a ready state in response to a determination that the second fiber is active.

8. The medium of claim 7, wherein the instructions to identify the state of the second zone include instructions to:

determine that the second zone is not in a ready state;

wherein the instructions to coordinate the print job include instructions to:

not proceed the print job from the first zone to the second zone in response to the determination that the second zone is not in a ready state; and send a wake signal to the second zone.

9. The medium of claim 7, wherein:

the second event flag indicates that second zone is in a ready state; and to coordinate the plurality of zones includes proceeding print media from the first zone to the second zone based on the determination that the second zone is in the ready state.

10. The medium of claim 7, further including instructions executable by the processing resource to:

associate a third zone of the printing device with a third event flag; and wherein to coordinate the plurality of zones includes advancing printing media through the first zone, the second zone, and the third zone, based on each of the first event flag, the second event flag, and the third event flag.

11. The medium of claim 10, wherein the instructions to coordinate the plurality of zones include instructions to:

send a wake signal from the first zone to the second zone.

12. The medium of claim 10, wherein the instructions to coordinate the plurality of zones include instructions to:

maintain the second zone and the third zone in a ready state until receipt of a wake signal from a preceding zone of the printing device.

13. A method comprising:

initializing a plurality of zones of a printing device;

setting a first zone among the plurality of zones to an active state using a first fiber associated with the first zone;

executing first print instructions using the first zone;

coordinating the plurality of zones by setting a second zone among the plurality of zones to the active state using a second fiber associated with the second zone; and returning the first zone to the initial state in response to the setting of the second zone to the active state, wherein the first fiber is to wait in a ready state in response to a determination that the second fiber is active.

14. The method of claim 13, including:

initiating motors in the second zone in response to the setting of the second zone in the active state.

15. The method of claim 13, wherein setting the second zone to the active state includes the first zone setting an event flag of the second zone.

* * * * *